US005947032A

United States Patent [19]

Meier

[11] Patent Number: 5,947,032

[45] Date of Patent: Sep. 7, 1999

[54] PORTABLE COOLER HAVING A REMOVABLE TABLE

[76] Inventor: Cady D. Meier, 23989 McIntosh Rd., Hollywood, Md. 20636

[21] Appl. No.: 09/152,121

[22] Filed: Sep. 14, 1998

[51] Int. Cl.[6] ..... A47B 3/00

[52] U.S. Cl. ..... 108/33; 108/42

[58] Field of Search ..... 108/35, 36, 33, 108/40, 34, 47, 42, 48, 152, 50.13; 312/317.1, 317.3, 277, 202, 201, 245

[56] References Cited

U.S. PATENT DOCUMENTS

| | | | |
|---|---|---|---|
| 1,317,895 | 10/1919 | Rudy | 108/33 X |
| 2,505,898 | 5/1950 | Jaffe et al. . | |
| 2,646,331 | 7/1953 | Gallo | 108/33 X |
| 3,683,825 | 8/1972 | Sheldon | 108/33 |
| 4,400,951 | 8/1983 | Cherry | 108/50.13 X |
| 4,488,623 | 12/1984 | Linnell, II et al. . | |
| 4,494,465 | 1/1985 | Fick, Jr. | 108/35 X |
| 5,694,860 | 12/1997 | Xiao | 108/48 X |

OTHER PUBLICATIONS

Sweet Catalog File 1942 ArchetO.

*Primary Examiner*—Jose V. Chen
*Attorney, Agent, or Firm*—Donald A. Kettlestrings

[57] ABSTRACT

A portable cooler includes an open-topped container having a cover and wherein the cover defines a hollow cavity therein for removably receiving and holding a table within the cavity. The table is provided with folding legs at one end, and the other table end is configured to be matingly received and supported by either one of two handles of the cooler.

12 Claims, 3 Drawing Sheets

PORTABLE COOLER HAVING A REMOVABLE TABLE

BACKGROUND OF THE INVENTION

This invention relates to a portable picnic cooler and more particularly to such a cooler having a table storable within a hollow cavity of the cooler cover.

When using picnic coolers, it is often desirable to have a table or other work surface upon which to position food or utensils. However, it is frequently inconvenient to carry a separate table with a picnic cooler. It is also inconvenient to use the cooler cover as a table because the cover must be moved to allow access to and closing of the cooler.

It is, therefore, an object of the present invention to provide a picnic cooler which stores a table in a hollow cavity of the cooler lid.

Another object is to provide such a cooler which enables the table to be quickly and easily removed from the cooler lid.

A further object of the invention is the provision of such a cooler wherein the table is configured in cooperation with the cooler so that the table can be supported with legs at one end of the table and by a cooler handle at the other end of the table.

Still another object is to provide such a cooler wherein the table can remain in a horizontal, operative position while the cooler lid can be raised and lowered to open and close the cooler.

A still further object is to provide such a cooler wherein the table can be removably locked into position within the hollow cavity of the cooler cover when the table is not in use.

Another object is to provide such a cooler wherein the table can be quickly and easily removed from the hollow cooler lid and wherein the table can be quickly and easily inserted into the hollow cooler lid.

Still another object is to provide such a cooler wherein the table can be quickly and easily erected for use in cooperation with the cooler and wherein the table can be quickly and easily inserted into the cooler cover for storage.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects, the present invention provides a container comprising: a base; a plurality of walls connected to each other and extending upwardly from the base to form an open-topped enclosure; a cover for removably resting on the walls to selectively cover the enclosure; the cover defining first and second cover ends, first and second cover sides connected to the ends and top and bottom cover surfaces extending between the ends and the sides; the cover further defining a hollow cavity therein, the cavity defining an open end formed within the first end; and a platform or table sized and configured for removably positioning the platform or table through the open end and within the cavity.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DESCRIPTION OF THE PREFERRED EMBODIMENT

Figure 1:
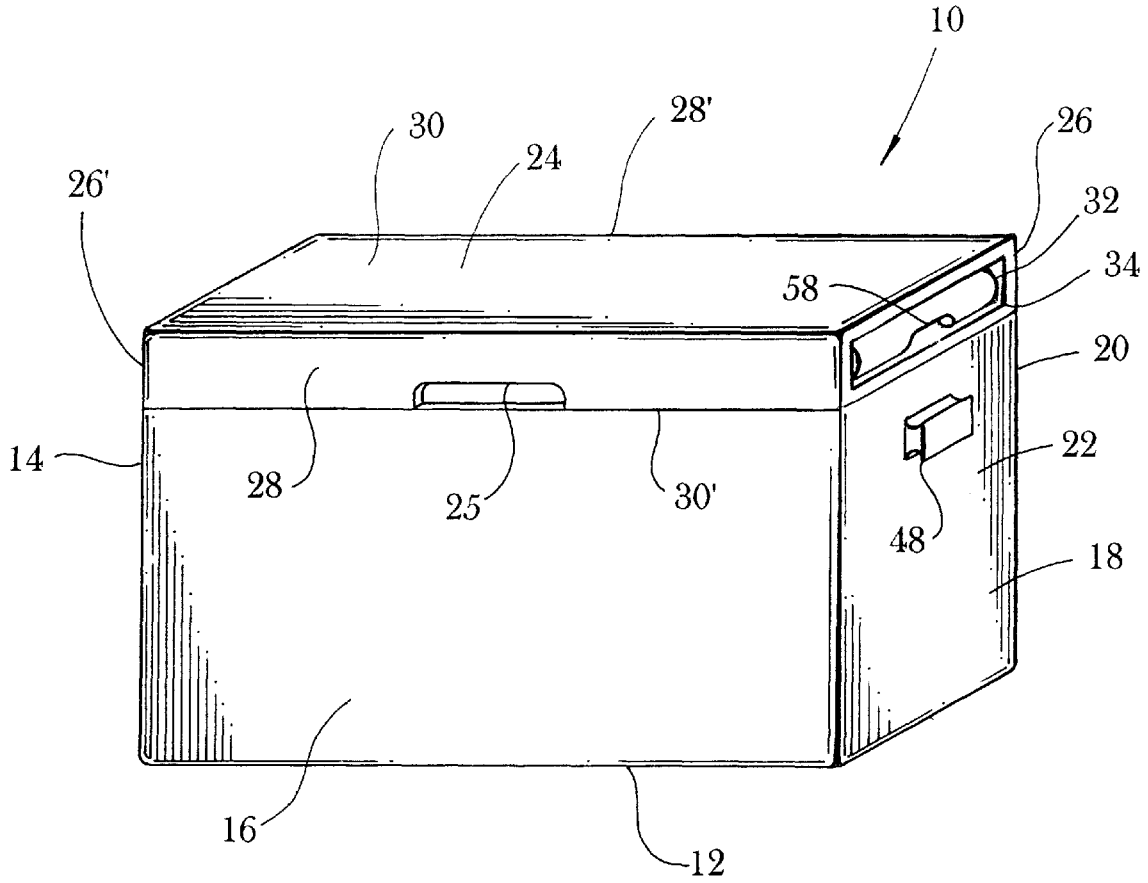
FIG. 1 is a perspective view of the cooler.
Figure 2:
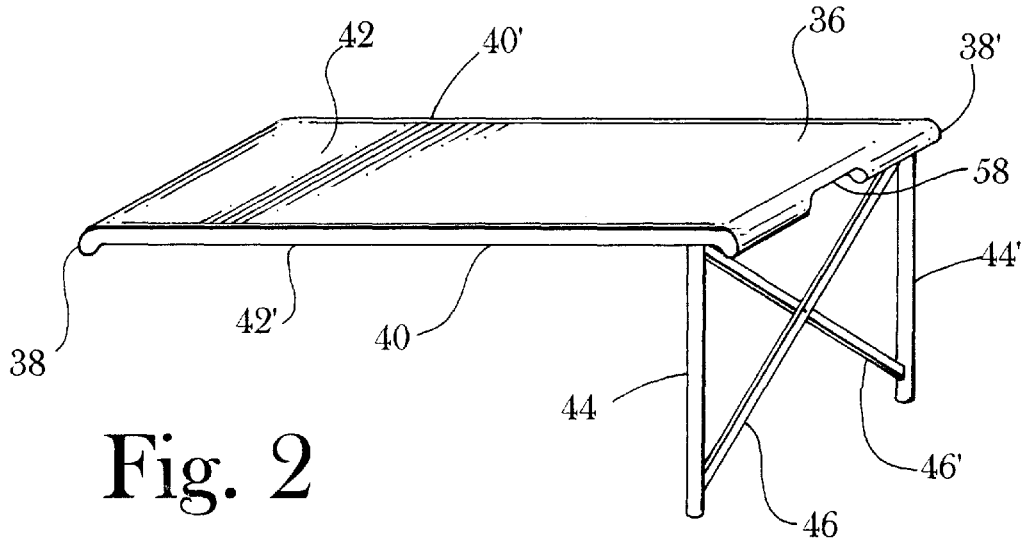
FIG. 2 is a perspective view of the table with the table legs extended.

With reference now to the drawings, wherein like reference characters designate like or corresponding parts throughout the several views, there is shown a container 10 which includes a base 12, a plurality of walls 14, 16, 18, 20 connected to each other and extending upwardly from base 12 to form an open-topped enclosure 22. Container 10 and enclosure 22 may be made in many sizes.

Container 10 further includes a cover 24 which is preferably hingedly connected in a conventional manner to rear wall 20. When cover 24 is in a closed position, it acts to cover enclosure 22 by resting on the tops of walls 14–20. Alternatively, cover 24 can be totally removable from tops of walls 14–20.

Cover 24 defines first and second cover ends 26, 26', first and second cover sides 28, 28' connected to ends 26, 26' and top and bottom cover surfaces 30, 30' extending between ends 26, 26' and sides 28, 28'.

In accordance with the invention, cover 24 defines a hollow cavity 32 therein, and cavity 32 defines an open end 34 formed within first end 26. A platform or table 36 is further provided which is sized and configured for removably positioning the platform or table through open end 34 and within hollow cavity 32.

Table 36 defines first and second table ends 38, 38', first and second table sides 40, 40' connected to ends 38, 38' and top and bottom table surfaces 42, 42' extending between table ends 38, 38' and table sides 40, 40'. Top table surface 42 is preferably a roughened or textured surface. Table 36 further includes table legs 44, 44' conventionally hingedly connected to bottom table surface 42' adjacent to end 38' for supporting table 36 when the table is removed from cavity 32. Table leg supports 46, 46' are preferably connected between legs 44, 44' to provide structural stability and strength for the legs while supporting table 36.

Figure 3:
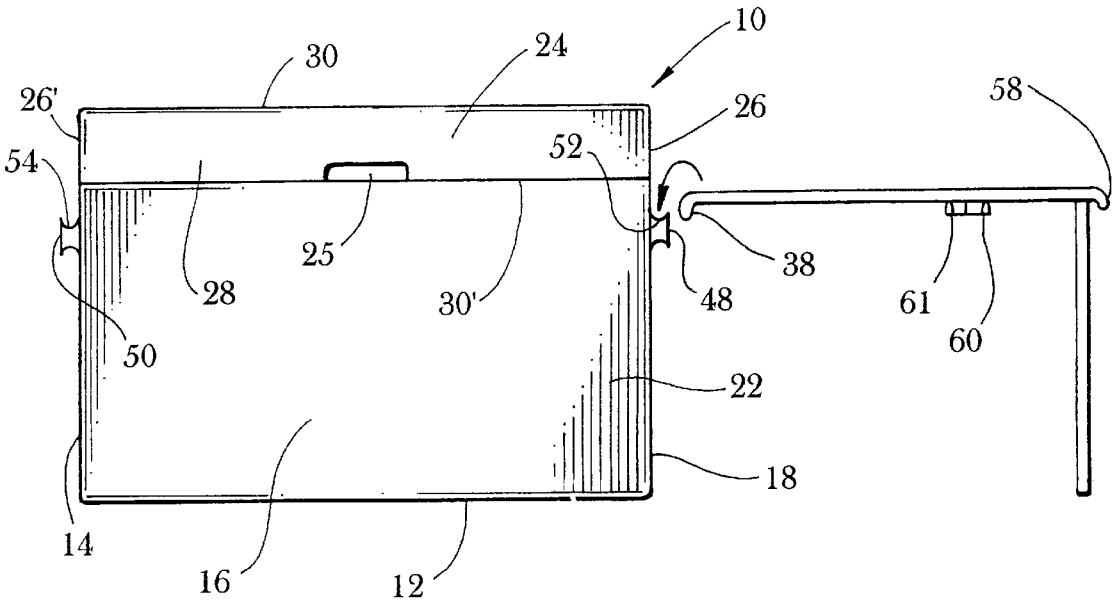
FIG. 3 is a front elevation view showing the cooler and the table with the table legs extended and showing how the table is positioned to be supported at one end by a handle of the cooler.
Figure 4:
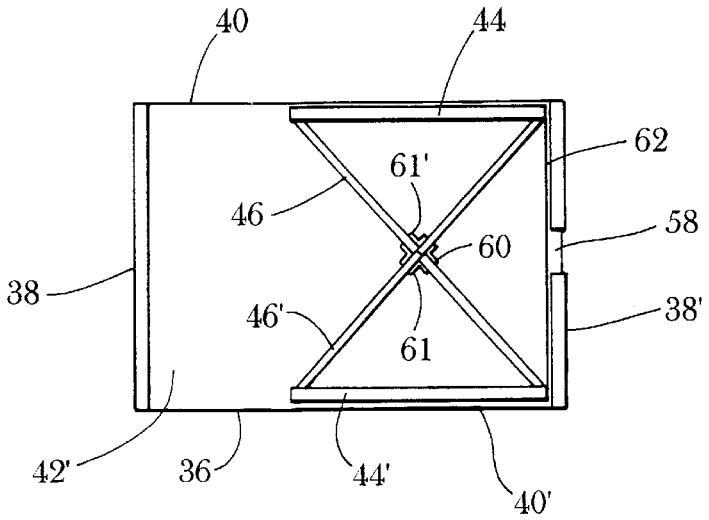
FIG. 4 is a bottom plan view showing the table with the table legs in a folded or collapsed position.
Figure 5:
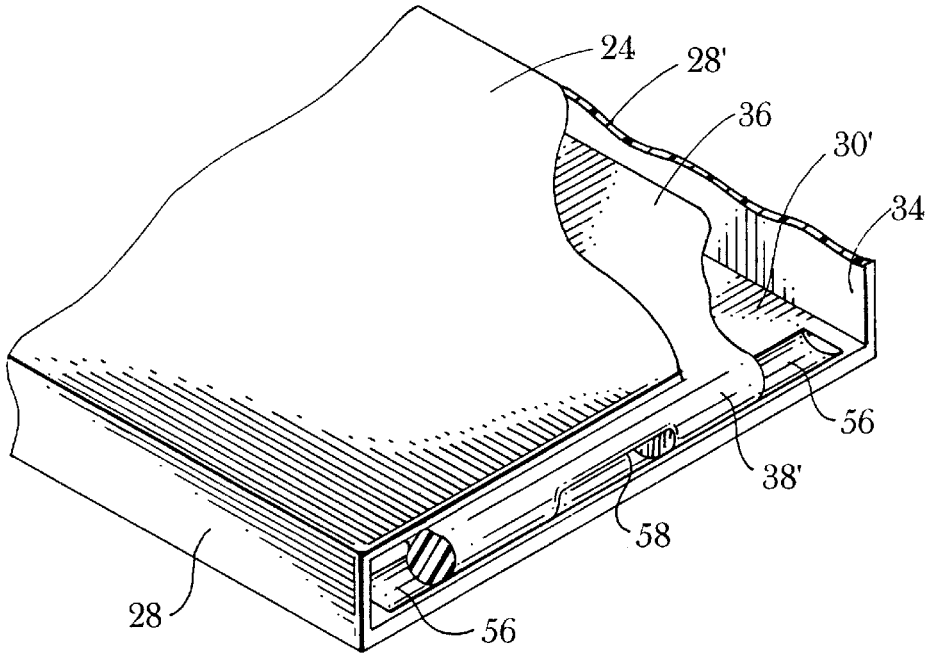
FIG. 5 is a fragmentary perspective view showing the table positioned within the hollow cavity of the cooler cover.

Container 10 further includes first and second handles 48, 50 connected, respectively to walls 18, 14 for lifting and carrying container 10 in a conventional manner. Handles 48, 50 are of predetermined configuration for removably receiving and supporting first table end 38 when table 36 has been removed from cavity 32 and when table legs 44, 44' have been hingedly moved or extended to support table 36. See FIG. 3.

In accordance with the invention, first handle 48 defines a first upwardly facing groove 52 therein and second handle 50 defines a second upwardly facing groove 54 therein. First table end 38 defines a first configuration for matingly and removably fitting into either first groove 52 or second groove 54 to support first table end 38. The first configuration defined by first table end 38 is preferably a half-round configuration.

Bottom cover surface 30' defines a third groove 56 therein contiguous with cavity 32 and extending adjacent to and parallel with open end 34. Second table end 38' defines a second configuration for matingly and removably fitting or locking into groove 56 to hold table 36 within cavity 32. The second configuration of second table end 38' is preferably a half-round configuration. Groove 56 is conventionally configured to preferably form a slightly greater than half-round shape with sufficiently flexible walls so that table end 38' can be snap-fitted and retained within groove 56.

A third handle 58 is provided in operative relationship with second table end 38' for enabling a user to grasp table 36, to lift the second configuration of second table end 38' from the snap-fit hold within third groove 56 and to pull table 36 out of cavity 32.

Container 10 further includes a holder 60 connected to table bottom surface 42' for releasably holding legs 44, 44' and leg supports 46, 46' in a folded position. Holder 60 is preferably configured so that supports 46, 46' can be snapped into position within channels 61, 61' of flexible holder 60 to enable holder 60 to frictionally engage and hold supports 46, 46' in a folded position. Supports 46, 46' and legs 44, 44' can be rotated about hinge 62, conventionally connected to bottom table surface 42', to positions to support table 36 by first manually removing supports 46, 46' from the snap-fit hold of holder 60.

Container 10 is preferably a conventionally insulated cooler, and base 12, walls 14–20 and cover 24 are preferably comprised of a conventional heat-insulating plastic material, such as polypropylene. Table 36, legs 44, 44', supports 46, 46' and holder 60 are also preferably comprised of a plastic material, such as polypropylene. All elements of container 10 are fabricated by conventional plastic fabrication methods. Container 10 may also be conventionally provided with wheels (not shown).

In operation and use, table 36, legs 44, 44', supports 46, 46' and holder 60 are sized and configured in relationship to cavity 32 and groove 56 such that end 38' of the table can be snap-fitted into groove 56 to hold or lock the table in position within cavity 32 when the table is not in use. Cover 24 of container 10 can be opened and closed in a normal manner while table 36 is held within cavity 32.

Table 36 can be removed from cavity 32 by the user grasping handle 58 and lifting upwardly to remove table end 38' from its snap-fit hold within groove 56. Handle 58 can then be used to pull and withdraw the table in a sliding manner from within cavity 32.

Supports 46, 46' are then removed from the snap-fit grasp of holder 60, and legs 44, 44' are rotated to an erected position for supporting table end 38'. A conventional locking arrangement (not shown) can be used to lock legs 44, 44' in the erected position. Table end 38 is then matingly and removably fitted onto either groove 52 or groove 54 to support first table end 38.

While table 36 is in the erected position described, with table end 38 supported by either handle 48 or 50 and with table end 38' supported by erected legs 44, 44', cover 24 of container 10 can be opened and closed in a conventional manner as required without disturbing table 36 and without disturbing any items positioned on the table. Cover 24 can be provided with a conventional handle 25 for enabling grasping of the cover by a user.

When it is desired to reposition table 36 within cavity 32, legs 44, 44' and supports 46, 46' are rotated about hinge 62 to a closed or folded position, and supports 46, 46' are repositioned or snap-fit into flexible holder 60. End 38 of the table is removed from upwardly facing groove 52 or from upwardly facing groove 54, and end 38 is inserted into and through open end 34. Table 36 is then pushed into cavity 32 until table end 38' is positioned above and in contact with groove 56. The user can then press table end 38' into groove 56 by use of handle 58 or by the user's fingers pressing downwardly on top table surface 42. Groove 56 is made of plastic, such as polypropylene, and the dimensions and conventional configuration of groove 56 are such that the half-round configuration of table end 38' will snap-fit into groove 56 to hold table 36 in locked position within cavity 32.

This invention provides a portable cooler which removably stores a table in a hollow cavity of the cooler cover, and wherein the table can be supported by one of the cooler handles in cooperation with foldable legs attached to the table. Movement of the cooler cover and access to the cooler is provided while the table is stored in the cooler and also while the table is in use.

The invention in its broader aspects is not limited to the specific details shown and described, and departures may be made from such details without departing from the principles of the invention and without sacrificing its chief advantages.

What is claimed is:

1. A container comprising:

a base;

a plurality of walls connected to each other and extending upwardly from said base to form an open-topped enclosure;

a cover for removably resting on said walls to selectively cover said enclosure;

said cover defining first and second cover ends, first and second cover sides connected to said ends and top and bottom cover surfaces extending between said ends and said sides;

said cover further defining a hollow cavity therein, said cavity defining an open end formed within said first end; and a platform sized and configured for removably positioning said platform through said open end and within said cavity.

2. A container as in claim 1 wherein said platform is a table defining first and second table ends, first and second table sides and top and bottom table surfaces extending between said table ends and said table sides, and further including table legs hingedly connected to said table for supporting said table when the table is removed from said cavity.

3. A container as in claim 2 further including first and second handles connected, respectively, to two of said walls for lifting and carrying said container, said handles of predetermined configuration for removably receiving and supporting said first table end when said table has been removed from said cavity and said table legs have been hingedly moved to support said table.

4. A container as in claim 3 wherein said first handle defines a first upwardly facing groove therein and said second handle defines a second upwardly facing groove therein; and wherein said first table end defines a first configuration for matingly and removably fitting into said first or second grooves to support said first table end.

5. A container as in claim 4 wherein said first configuration is half-round.

6. A container as in claim 5 wherein said bottom cover surface defines a third groove therein contiguous with said cavity, said third groove extending adjacent to and substantially parallel with said open end; and wherein said second table end defines a second configuration for matingly and removably fitting into said third groove to hold said table within said cavity.

7. A container as in claim 6 wherein said second configuration is half-round.

8. A container as in claim 7 further including a third handle in operative relationship with said second table end for enabling a user to grasp said third handle, to lift said second configuration from said third groove and to pull said table out of said cavity.

9. A container as in claim 8 wherein said container is an insulated cooler, said base, walls and cover comprised of heat insulating material.

10. A container as in claim 9 further including a holder connected to said cover bottom surface for releasably holding said legs in a folded position.

11. A container as in claim 10 wherein said base, walls, cover, table, legs and holder are comprised of plastic.

12. A container as in claim 11 wherein said cover is hingedly connected to one of said walls.

* * * * *